US008684313B2

(12) United States Patent
Harrington

(10) Patent No.: US 8,684,313 B2
(45) Date of Patent: Apr. 1, 2014

(54) INFLATABLE KITE WITH LEADING EDGE SWEPT FORWARDS AT WINGTIP

(75) Inventor: Ross Harrington, Victoria (CA)

(73) Assignee: Ocean Rodeo Sports Inc., Victoria, British Columbia (CA)

( * ) Notice: Subject to any disclaimer, the term of this patent is extended or adjusted under 35 U.S.C. 154(b) by 81 days.

(21) Appl. No.: 13/363,322

(22) Filed: Jan. 31, 2012

(65) Prior Publication Data

US 2012/0193482 A1 Aug. 2, 2012

Related U.S. Application Data

(60) Provisional application No. 61/438,873, filed on Feb. 2, 2011.

(51) Int. Cl.
*B64C 31/06* (2006.01)

(52) U.S. Cl.
USPC ..... 244/153 R; 244/155 A; 244/145

(58) Field of Classification Search
USPC ..... 244/153 R, 142, 145, 146
See application file for complete search history.

(56) References Cited

U.S. PATENT DOCUMENTS

| | | | | |
|---|---|---|---|---|
| 4,892,272 | A * | 1/1990 | Hadzicki | 244/153 R |
| 5,033,698 | A * | 7/1991 | Schimmelpfennig | 244/153 R |
| 5,433,401 | A * | 7/1995 | Ricketts | 244/153 R |
| 5,556,057 | A * | 9/1996 | Davies | 244/153 R |
| 7,017,860 | B2 * | 3/2006 | Royannais et al. | 244/155 A |
| 7,093,803 | B2 * | 8/2006 | Culp | 244/153 R |
| 7,494,093 | B2 * | 2/2009 | Legaignoux et al. | 244/145 |
| 7,810,759 | B2 * | 10/2010 | Eberle et al. | 244/155 A |
| 2007/0001057 | A1 * | 1/2007 | Vincent et al. | 244/900 |
| 2008/0231058 | A1 * | 9/2008 | Nicholson et al. | 290/55 |
| 2009/0179112 | A1 * | 7/2009 | Gu | 244/153 R |
| 2009/0277997 | A1 * | 11/2009 | Shogren et al. | 244/153 R |
| 2012/0006945 | A1 * | 1/2012 | Stiewe | 244/153 R |

FOREIGN PATENT DOCUMENTS

| | | | |
|---|---|---|---|
| AU | 2856501 | A | 1/2002 |
| DE | 10237034 | A1 | 2/2004 |
| DE | 102006018444 | A1 | 12/2007 |
| FR | 2759300 | A1 | 8/1998 |
| FR | 2850355 | A1 | 7/2004 |
| FR | 2905670 | A1 | 3/2008 |
| WO | 03031258 | A1 | 4/2003 |

OTHER PUBLICATIONS

International Search Report Corresponding to PCT/CA2012/000115 mailed Jun. 28, 2012.

* cited by examiner

*Primary Examiner* — Christopher P Ellis
*Assistant Examiner* — Medhat Badawi
(74) *Attorney, Agent, or Firm* — Davis & Bujold, PLLC; Michael J. Bujold

(57) ABSTRACT

An inflatable kite has a continuous leading edge tube that is swept forward at its left and right wingtip ends so that bridle lines attaching the canopy to the user are forward of the center of effort of the kite.

3 Claims, 11 Drawing Sheets

INFLATABLE KITE WITH LEADING EDGE SWEPT FORWARDS AT WINGTIP

CROSS-REFERENCE TO RELATED APPLICATIONS

This application claims the benefit of U.S. Provisional Patent Application 61/438,873 filed on Feb. 2, 2012 by the same inventor for the same subject matter.

FEDERAL FUNDING

N/A

FIELD OF THE INVENTION

This invention is related to kites used in the sport of kite boarding and more specifically to an inflatable kite having a leading edge swept forwards at the wingtip.

1. Background of the Invention

Kite surfing or Kite boarding is a surface water sport that uses the wind to pull a rider through the water on a small surfboard or a kite board (similar to a wakeboard). The terms kite boarding and kite surfing are interchangeable. There are a number of different styles of kite boarding, including freestyle (most common and utilizes standard kite and board) or wake-style (flatter water using board with bindings) and wave-riding which is focused on big waves using a board designed for wave riding.

A kite surfer or kite boarder uses a board with or without foot-straps or bindings, combined with the power of a controllable kite to propel the rider and the board across the water. Riding styles have evolved to suit riders and conditions, such as wake style, wave riding, freestyle, free ride, jumping, and cruising.

The sport is becoming somewhat safer due to innovations in kite design, safety release systems, and instructions, however there are numerous deaths every year, and injuries due to body drag on land and water, hitting obstacles on land or water, or getting entangled in the lines.

All modern kites dedicated to kite surfing provide a "depower" option to reduce the power in the kite. By using depower, the kite's angle of attack to the wind is reduced, thereby catching less wind in the kite and reducing the power or pull.

A person practicing kite boarding is usually connected to the kite by means of a central line attached to a harness the user wears. This central line splits into two lines at some point above the control bar and these two lines, called front lines, attach to the front bridles on the kite, or on kites without bridles they attach directly to the leading edge of the wingtip. The side-lines, called back lines, connect to the outside ends of the control bar, which is held in the user's hands, and to the rear bridle on the kite or on kites without a bridle they attach directly to the trailing edge of the wingtip. The user's pulling or pushing the control bar towards or away from the harness alters the kite's angle of attack relative to the wind, causing an increase or decrease in the pulling force of the kite. Pulling the right side of the steering bar towards the user turns the kite to the right. Pulling the left side of the steering bar towards the user turns the kite to the left. All kites with a central control line passing through the middle of the control bar are controlled in the way described above.

2. Discussion of the Prior Art

FIGS. 1 to 6 illustrates examples of prior art leading edge inflatable kites (LEI). In FIG. 1, a LEI kite (1) is illustrated having an inflatable leading edge tube (2) swept rearwards at the wingtips (16). The kite comprises a canopy (4), struts (6), bridle attachments (8) on the leading edge tube (2), bridle lines (10), a front tow point (12), a wingtip front bridle attachment (30), a rear tow point (14), a rear wingtip bridle attachment (32), a wingtip (16) having a rounded plan form outline (26) and a center of effort (20). FIG. 2 illustrates a similar LEI kite (1) having a wingtip (16) having a truncated plan form outline (28). FIG. 3 shows a different embodiment of the LEI kite (1) of FIG. 2 in which the top end of the inflatable edge tube (2) is swept forward at the centre. FIG. 4 is a top view of the prior art LEI kite of FIG. 1. FIG. 5 is a top view of the prior art LEI kite of FIG. 2. FIG. 6 is a top view of the prior art LEI kite of FIG. 3.

In these prior art embodiments improvements can be made to aerodynamic efficiency by moving the wingtip front bridle attachment forwards, as this will move the front tow point forwards in relation to the center of effort. This will increase the amount that the rider is able to decrease the angle of attack of the kite, thus increasing the depower capability. However, as the prior art figures show, to move the wingtip front bridle attachment (30) further forwards means it must be moved further up the leading edge tube. This makes it hard to properly support the leading edge arc and prevent it from collapsing while under load. This can also cause the section of the leading edge tube that goes from the wingtip front bridle attachment to the wingtip rear bridle attachment to buckle while under load or when turning the kite. Another option is to decrease the amount that the leading edge tube is swept rearwards however this has a negative effect on the relaunch capability of the kite, when crashed on the water, and it decreases the amount of depower as it moves the center of effort on the kite forwards.

Therefore, there is a continued need for an LEI kite to have improved aerodynamic and re-launch capabilities by back-sweeping the inflated leading edge of the kite while at the same time being able to move the front tow points more forwards without having to move the wingtip front bridle attachment higher up on the leading edge tube.

DESCRIPTION OF FIGURE NUMBERS

1—Kiteboarding kite
2—Inflated leading edge tube
4—Canopy
6—Strut
8—Bridle attachment on leading edge tube
10—Bridle line
12—Front tow point
14—Rear tow point
16—Wingtip
18—Forward swept section of leading edge at wingtip
20—Center of effort
22—Vertical line showing positioning of center of effort on side view of kite
24—Horizontal distance from front tow point to center of effort
26—End of wingtip rounded
28—End of wingtip truncated
30—Wingtip front bridle attachment
32—Wingtip rear bridle attachment

DETAILED DESCRIPTION OF THE INVENTION

Figure 1:
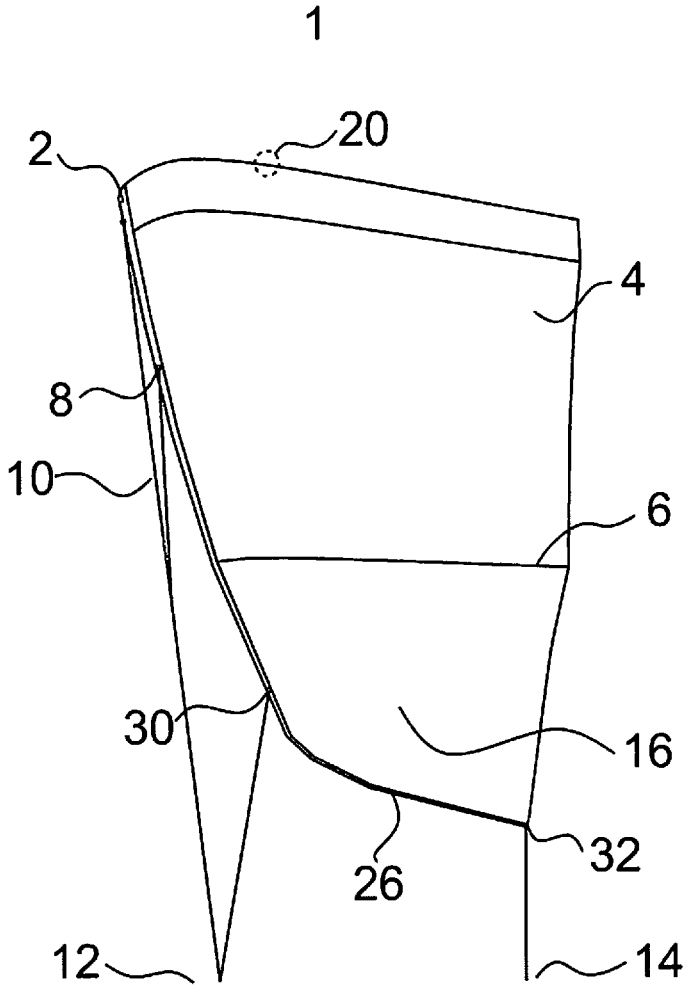
PRIOR ART Fig. 1
FIG. 1—Side view of prior art kite with rounded wingtips.
Figure 2:
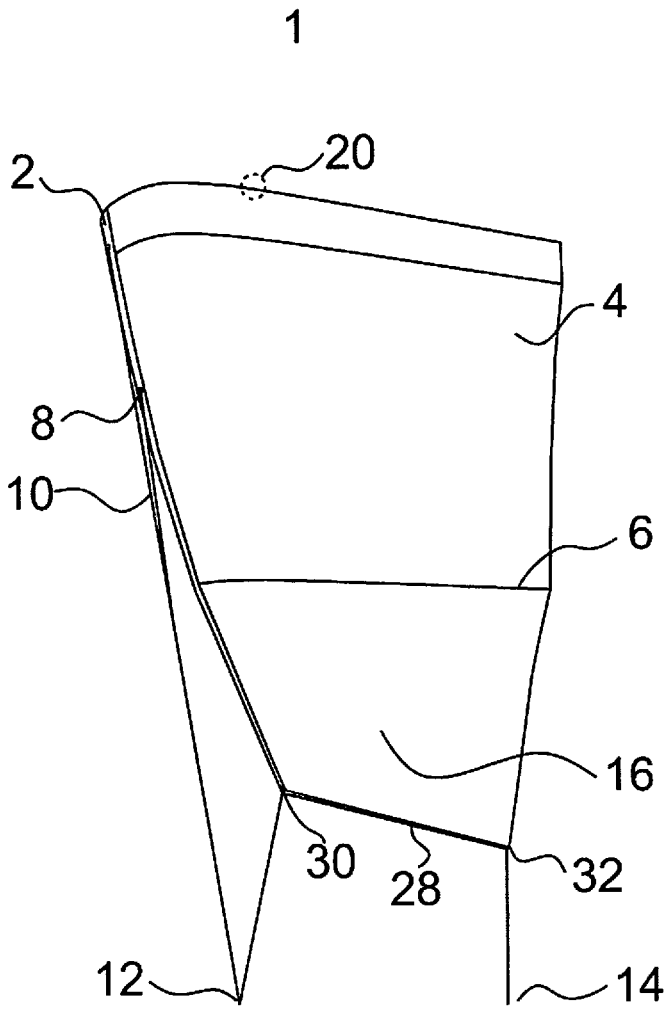
PRIOR ART Fig. 2
FIG. 2—Side view of prior art kite with truncated wingtips.
Figure 3:
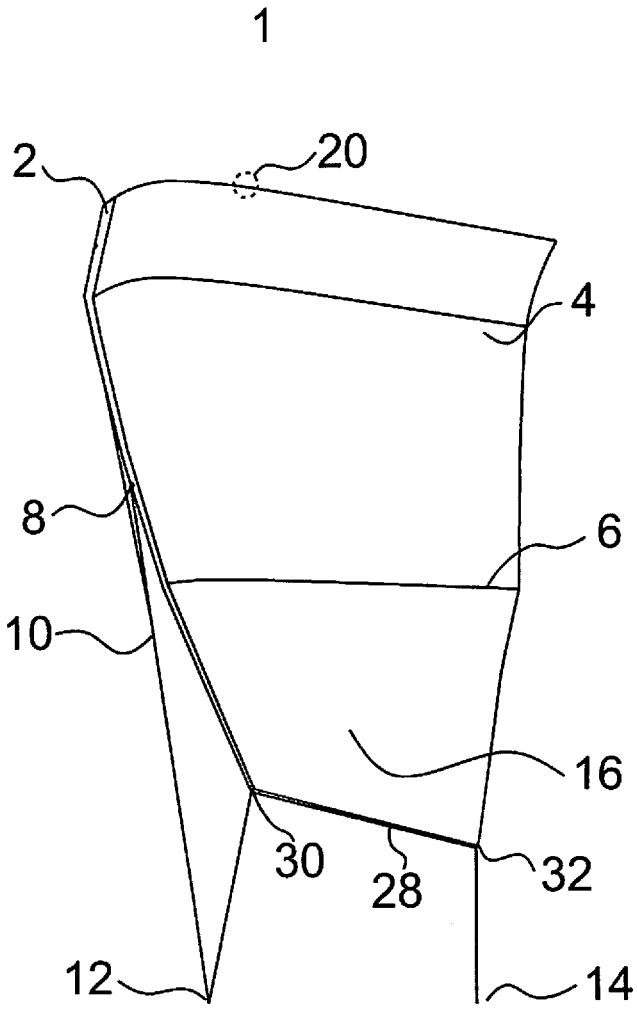
PRIOR ART Fig. 3
FIG. 3—Side view of prior art kite with leading edge swept forwards at center.
Figure 4:
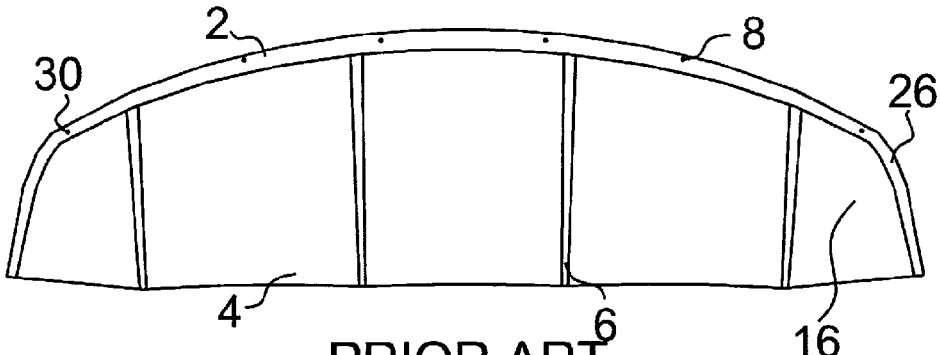
PRIOR ART Fig. 4
FIG. 4—Top flat view of prior art kite with rounded wingtips.
Figure 5:
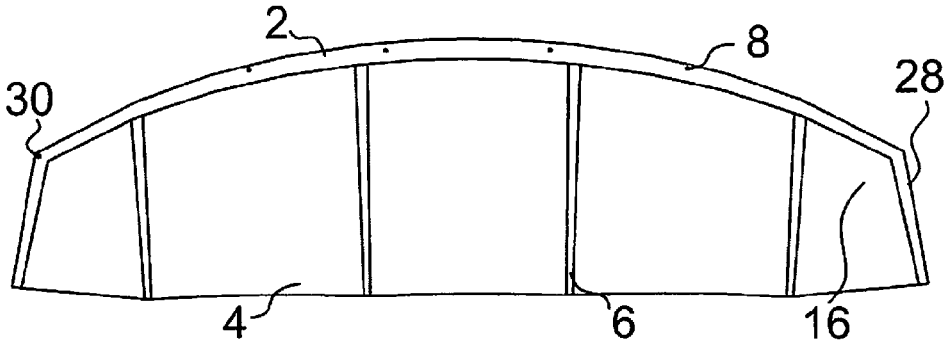
PRIOR ART Fig. 5
FIG. 5—Top flat view of prior art kite with truncated wingtips.
Figure 6:
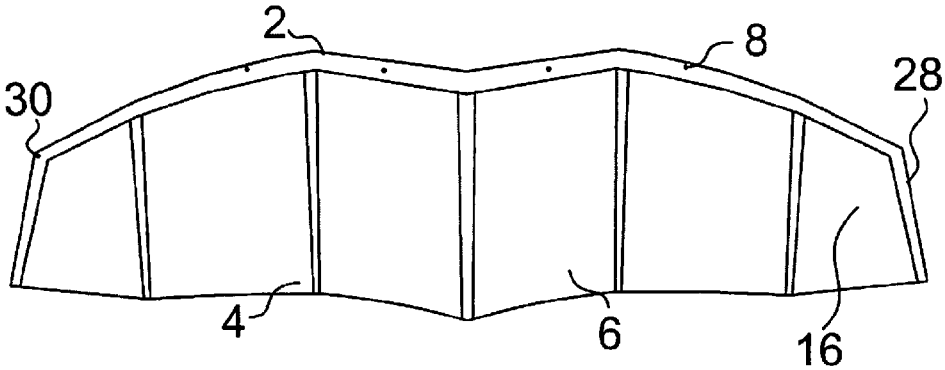
PRIOR ART Fig. 6
FIG. 6—Top flat view of prior art kite wing leading edge swept forwards at center.
Figure 7:
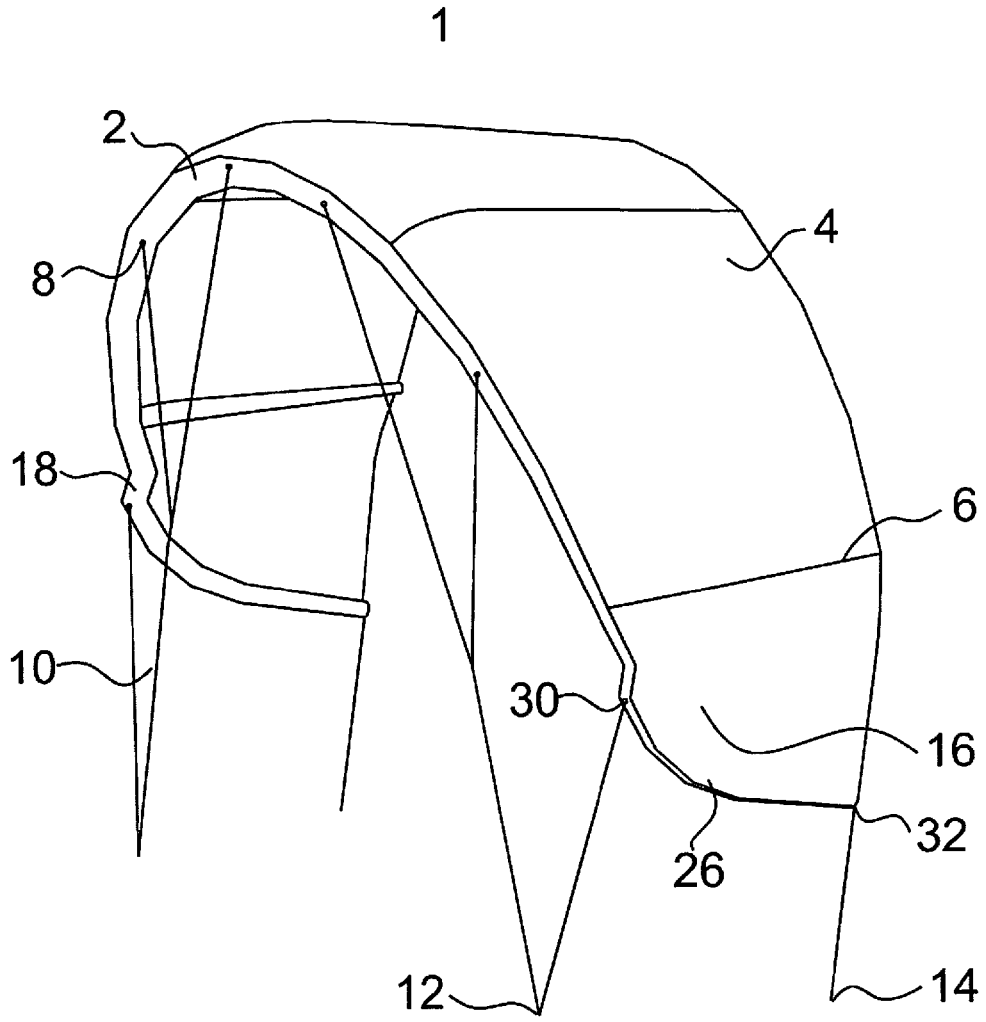
FIG. 7—Perspective view of kite with leading edge swept forward at wingtips and ends of wingtips rounded.
Figure 8:
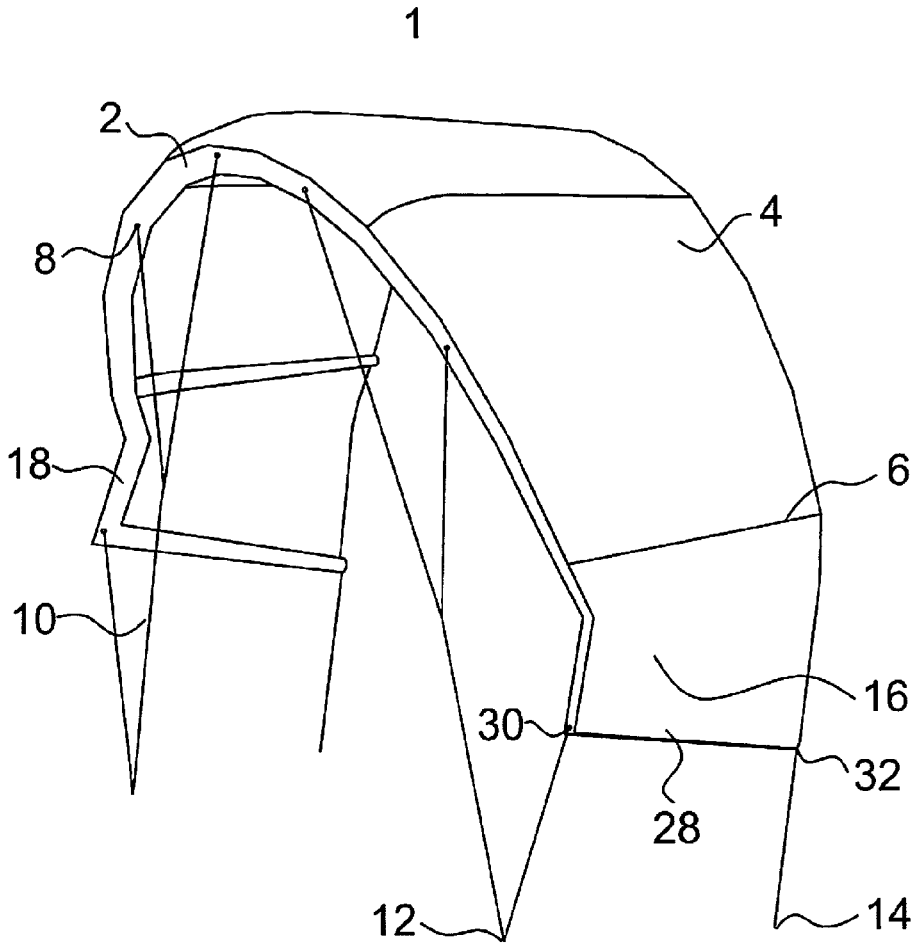
FIG. 8—Perspective view of kite with leading edge swept forward at wingtips and ends of wingtips truncated.
Figure 9:
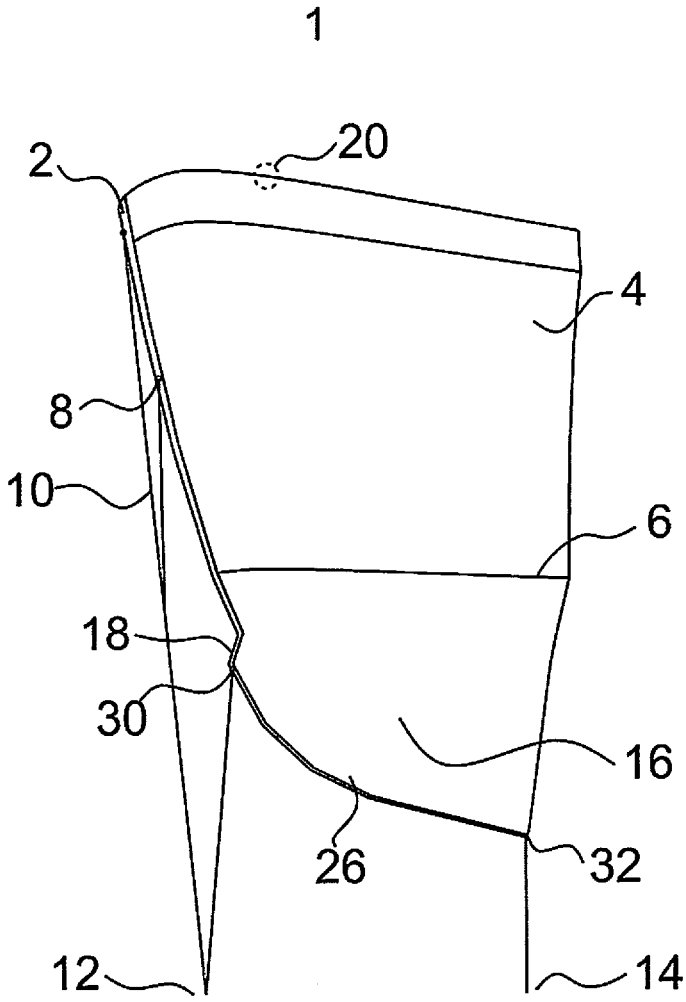
FIG. 9—Side view of kite with leading edge swept forward at wingtips and ends of wingtips rounded.
Figure 10:
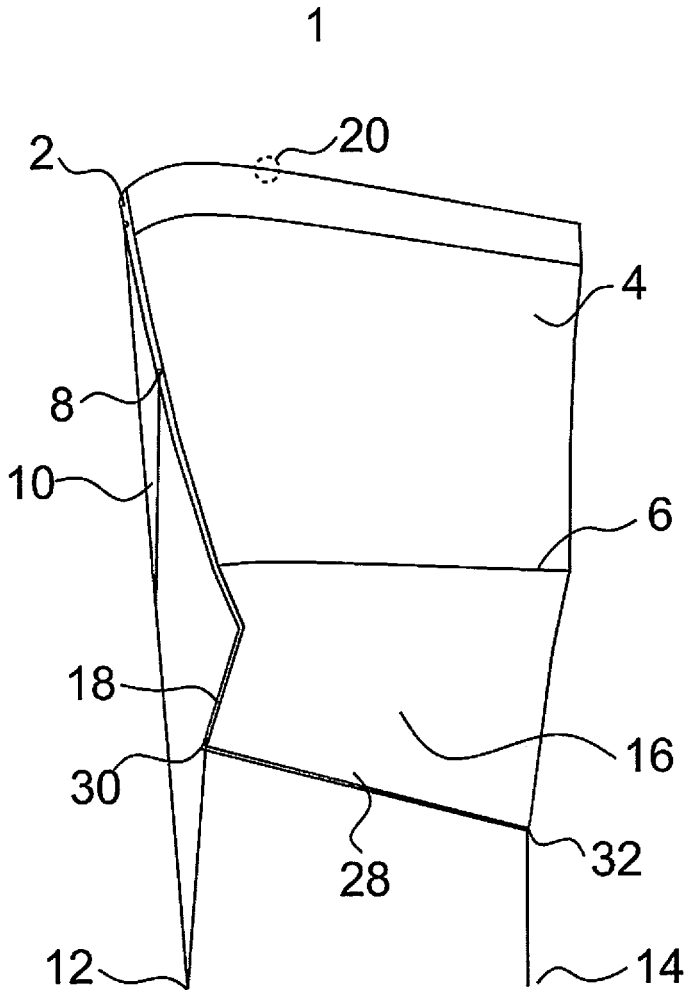
FIG. 10—Side view of kite with leading edge swept forward at wingtips and ends of wingtips truncated.
Figure 11:
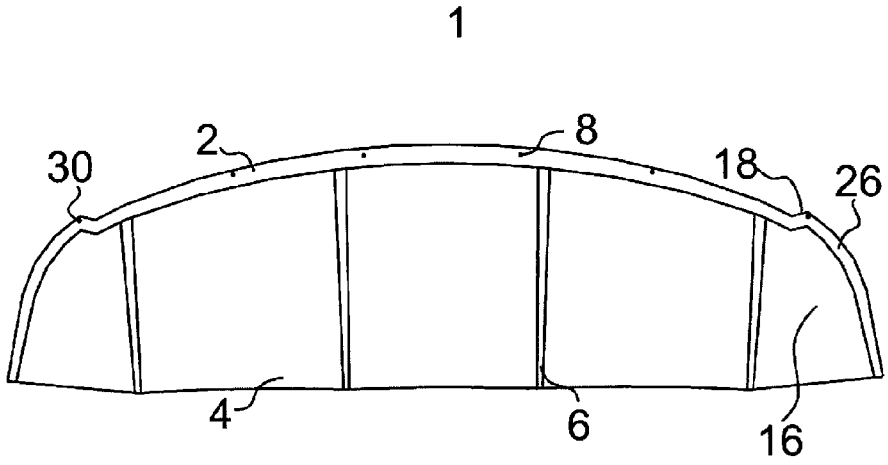
FIG. 11—Top flat view of kite with leading edge swept forward at wingtips and ends of wingtips rounded.
Figure 12:
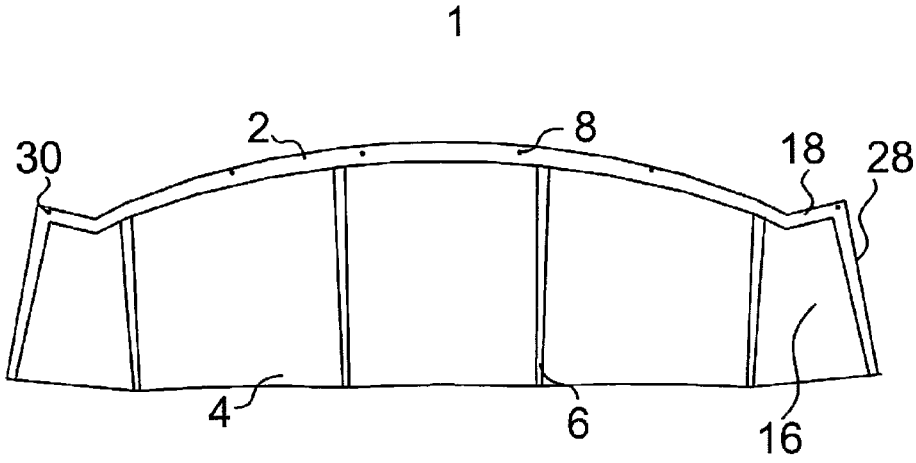
FIG. 12—Top flat view of kite with leading edge swept forward at wingtips and ends of wingtips truncated.
Figure 13:
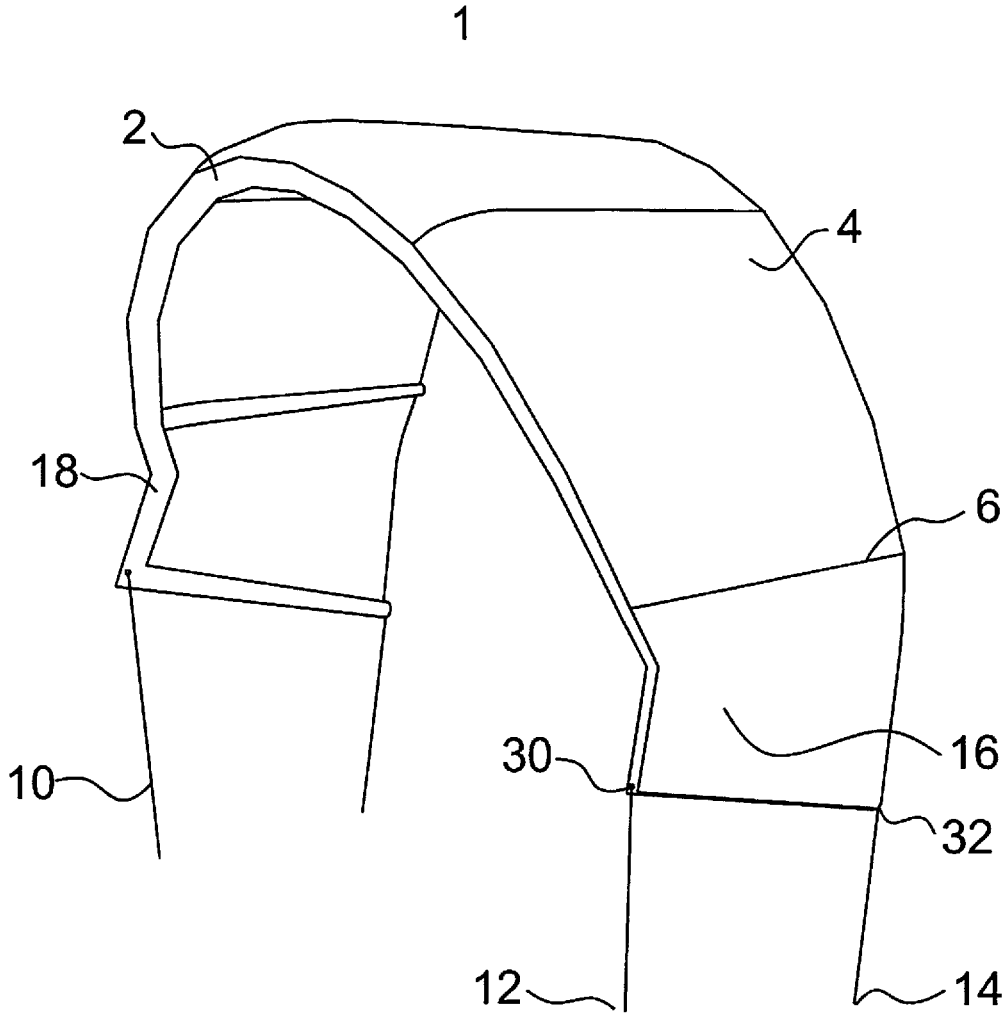
FIG. 13—Perspective view of kite with leading edge swept forward at wingtips that only has bridles on wingtip.
Figure 14:
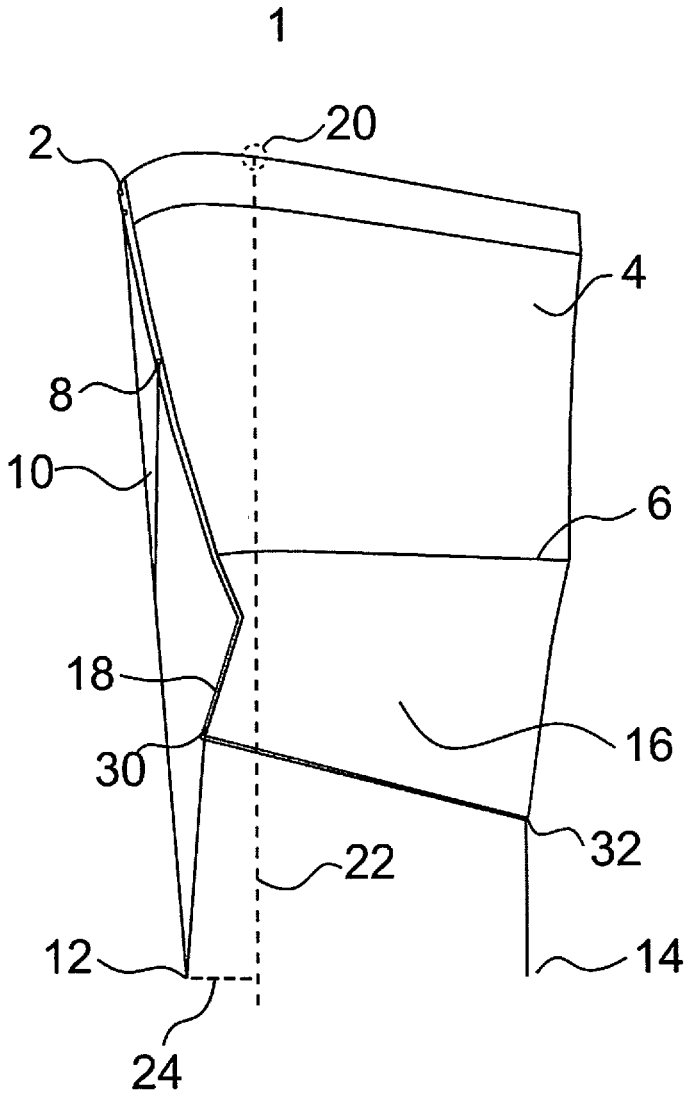
FIG. 14—Side view of kite with leading edge swept forward at wingtips showing relationship between front tow point and center of effort.

Referring to FIGS. 7 to 14 there is shown various view of a preferred embodiment of the invention which is an LEI kite (1) with the inflated leading edge tube (2) swept forwards (18) at wingtip so that the wingtip bridle attachment (30) is moved forwards on the leading edge tube (2). The front tow point (30) is forward of the center of effort (20) of the kite wing thus increasing the depower capabilities of the kite.

The kite (1) comprises a canopy (4) supported by a plurality of parallel struts (6). The leading edge tube runs between the two rear connection points (32) on either side of the canopy. The rear bridle attachments are located at attachment points (32) and the front bridle attachment points are located on the leading edge tube at (30) and (8). The front bridle lines (10) converge at front tow point (12) and the rear bridle lines converge at rear tow point (14). The wingtip (16) has a rounded edge (26) comprising a swept back portion of the inflatable leading edge tube (2). Just prior to the swept back portion (26) of the wingtip, the leading edge portion (18) is swept forward so that the bridle line attachment points (30) are forward of the center of effort (20) of the kite.

FIG. 17 shows the horizontal distance from the front tow point (24) to a vertical line showing the position of the center of effort (22).

What is claimed is:

1. An inflatable kite comprising:

a canopy sheet having a leading edge and a trailing edge, and a left edge and a right edge;

a canopy supporting frame assembly attached to the canopy sheet and comprising an inflatable leading edge tube attached to the leading edge, the left edge and the right edge and struts disposed between the leading edge and the trailing edge;

the leading edge having swept back portions at each of the left edge and the right edge:

the leading edge having swept forward portions just prior to each of the swept back portions; and line attachments on the swept forward portions.

2. The inflatable kite of claim 1 wherein bridle lines attached to the leading edge tube and attached to the line attachments on the swept forward portions converge to a front tow point.

3. The inflatable kite of claim 1 wherein front flying lines connect directly to the line attachments on the swept forward portions.

* * * * *